US009074777B2

(12) United States Patent
Catalogne et al.

(10) Patent No.: US 9,074,777 B2
(45) Date of Patent: Jul. 7, 2015

(54) OVEN DOOR FOR A DOMESTIC COOKING OVEN

(75) Inventors: Cedric Catalogne, Torreano di Martignacco (IT); Karl Leidig, Insingen (DE)

(73) Assignee: ELECTROLUX HOME PRODUCTS CORPORATION N.V., Brussel (BG)

( * ) Notice: Subject to any disclaimer, the term of this patent is extended or adjusted under 35 U.S.C. 154(b) by 85 days.

(21) Appl. No.: 13/577,502

(22) PCT Filed: Feb. 28, 2011

(86) PCT No.: PCT/EP2011/000953

§ 371 (c)(1), (2), (4) Date: Oct. 26, 2012

(87) PCT Pub. No.: WO2011/104034

PCT Pub. Date: Sep. 1, 2011

(65) Prior Publication Data

US 2013/0220296 A1 Aug. 29, 2013

(30) Foreign Application Priority Data

Feb. 26, 2010 (EP) ..... 10001981

(51) Int. Cl.

*F24C 15/02* (2006.01)
*F24C 15/04* (2006.01)
*F24C 15/14* (2006.01)

(52) U.S. Cl.

CPC ..... *F24C 15/028* (2013.01); *F24C 15/04* (2013.01); *F24C 15/021* (2013.01); *F24C 15/02* (2013.01); *F24C 15/14* (2013.01)

(58) Field of Classification Search

CPC ..... F24C 15/028; F24C 15/02; F24C 15/021; F24C 15/04; F24C 15/14

USPC ..... 126/198, 200; 219/405, 531; 52/204.593, 786.11

See application file for complete search history.

(56) References Cited

U.S. PATENT DOCUMENTS 3,192,575 A 7/1965 Rosenau et al.
3,626,154 A 12/1971 Reed (Continued)

FOREIGN PATENT DOCUMENTS

DE 19705697 6/1998
EP 0299935 1/1989

(Continued)

OTHER PUBLICATIONS

International Search Report for PCT/2011/000953, dated Aug. 8, 2011, 3 pages.

*Primary Examiner* — Alfred Basichas
(74) *Attorney, Agent, or Firm* — Pearne & Gordon LLP

(57) ABSTRACT

The present invention relates to an oven door for a domestic cooking oven. The oven door comprises a first inner glass panel (10) in direct contact to an oven cavity (34), a second inner glass panel (12) plane-parallel to the first inner glass panel (10) and a void of air intermediate space (18) between the first inner glass panel (10) and the second inner glass panel (12). The oven door comprises further a reflective layer (22) at an inner side of the second inner glass panel (12) in order to reflect radiant heat from the oven cavity (34) and/or at an outer side of the first inner glass panel (10) in order to reduce radiant heat emission from the oven cavity (34). An outer glass panel (14) of the oven door is in direct contact to an ambiance (36). Further, the present invention relates to a corresponding domestic cooking oven.

20 Claims, 2 Drawing Sheets

(56) References Cited

U.S. PATENT DOCUMENTS

Figure 1:
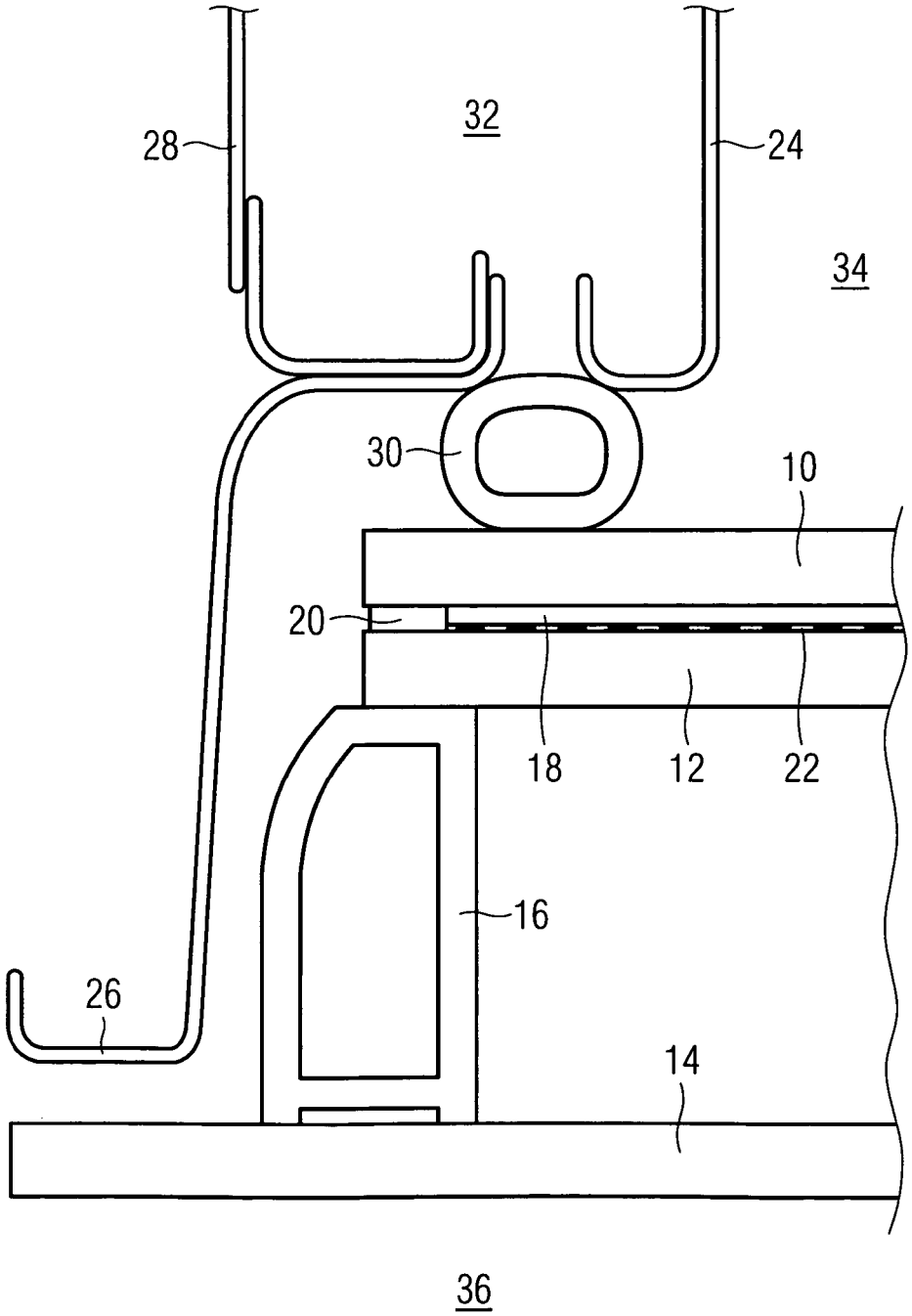

| | | | |
|---|---|---|---|
| 3,692,015 | A | 9/1972 | Chase et al. |
| 3,893,442 | A | 7/1975 | Nuss |
| 4,084,571 | A | 4/1978 | McFarland |
| 7,703,451 | B2 | 4/2010 | Bang |
| 8,716,631 | B2 | 5/2014 | Venezia et al. |
| 2003/0029440 | A1 | 2/2003 | Gros et al. |
| 2009/0194090 | A1 | 8/2009 | Kim et al. |
| 2013/0049559 | A1 | 2/2013 | Koitzsch et al. |

FOREIGN PATENT DOCUMENTS

| | | |
|---|---|---|
| EP | 0900985 | 5/2003 |
| EP | 0811806 | 2/2004 |
| EP | 1178264 | 2/2004 |
| EP | 1612488 | 12/2007 |
| EP | 1548367 | 10/2010 |
| EP | 1081437 | 7/2013 |
| JP | 2007153701 | 6/2007 |

OVEN DOOR FOR A DOMESTIC COOKING OVEN

The present invention relates to an oven door for a domestic cooking oven. Further, the present invention relates to a domestic cooking oven with at least one oven cavity.

The closed oven door of the cooking oven is arranged between a very high temperature of the oven cavity and a low temperature of the ambiance. The outer side of the oven door must have such a temperature, so that the outer side of the oven door is touchable by the user. Further, the heat transfer from the oven cavity to the ambiance should be minimized, so that the energy consumption is not too high and the cooking performance is not impaired.

A typical conventional oven door comprises a number of glass panels, for example three or four glass panels. The glass panels are arranged in layers and plan-parallel to each other. Many conventional oven doors are vented, wherein air circulates between the glass panels. The circulating air is moved by the cooling system usually placed on the top of the cooking oven.

The heat transfer from the hot inner glass panel in direct contact with the oven cavity to the outer glass panel in direct contact with the ambiance is a combination of three heat transfer modes. There is a radiant heat transfer from a surface of the glass panel to a surface of the next glass panel. There is convection in the intermediate spaces between the glass panels due to the air motion generated by the cooling system or by natural convection. Further, there is heat conduction within the glass panels.

In order to reduce the radiant heat transfer a reflective layer is coated on the inner side of the inner glass panel. By the vented oven door the outer side of said oven door is cooled down enough, that the user can touch it. However, also the inner glass is cooled down resulting in additional energy consumption. The temperature gradient within the vented oven door is substantially uniform.

CA 2 502 865 discloses an oven door assembly with an outer transparent panel and an inner window pack separated from said outer panel. The inner window pack includes two substantially parallel window panels spaced from each other. Between said two window panels an inner dead air space is established. Additional dead air spaces are provided in upper and lower regions of the door in order to establish a uniform insulation or thermal barrier allowing the construction of a thin profile door.

DE 10 2007 030 031 B3 describes an insulating glazing element. The insulating glazing element comprises a glass panel arrangement with two or more glass panels space apart in a predefined manner from each other, so that evacuated spaces are formed between said glass panels. The distance between the glass panels is provided by spacers. The spaces are sealed by sealing means from the environment. The glazing element is applicable for domestic heating devices.

It is an object of the present invention to provide an oven door for a domestic cooking oven, which allows an improved insulation of the oven door and a reduced energy consumption of the cooking oven, wherein the raw materials and supplies are relative small.

The object of the present invention is achieved by the oven door for a domestic cooking oven according to claim 1.

The oven door according to the present invention comprises:

- a first inner glass panel in direct contact to an oven cavity,
- a second inner glass panel plane-parallel to the first inner glass panel,

- a void of air intermediate space between the first inner glass panel and the second inner glass panel,
- a reflective layer at an inner side of the second inner glass panel, so that radiant heat from the oven cavity is reflected, and/or at an outer side of the first inner glass panel, so that emission of radiant heat from the oven cavity is reduced, and
- an outer glass panel in direct contact to an ambiance.

The core of the present invention is the combination of the void of air intermediate space and the reflective layer within said intermediate space. The void of air intermediate space allows low heat conductivity. The reflective layer prevents radiant heat transfer through the oven door.

According to a preferred embodiment of the present invention the thickness of the intermediate space is between 0.5 mm and 1 mm. The thickness of the intermediate space corresponds with the distance between the first inner glass panel and the second inner glass panel. The distance between 0.5 mm and 1 mm allows the sufficiently small heat conductivity on the one hand and a mechanical stability of the first inner glass panel and the second inner glass panel.

Further, the heat conductivity of the intermediate space may be lower than $10^{-2}$ W/(m·K), in particular between $0.4 \cdot 10^{-3}$ W/(m·K) and $0.6 \cdot 10^{-3}$ W/(m·K). A typical value for the heat conductivity of the intermediate space may be about $0.5 \cdot 10^{-3}$ W/(m·K).

Preferably, the circumferential sides of the intermediate space are enclosed by a solder or glue. Further, the first inner glass panel and the second inner glass panel may be fixed together by the solder. The solder guarantees the impermeability of the intermediate space and the mechanical stability of the module including the first and second inner glass panel.

In order to ensure the thickness of the intermediate space, at least one spacer is arranged between the first inner glass panel and the second inner glass panel.

Further, the reflective layer may include at least one high reflective material. In particular, the reflective layer comprises high reflective properties in the wavelength range higher than 1700 nm. This is the substantial range of radiant heat from the oven cavity.

At least one pair of door columns may be arranged between the second inner glass panel and the outer glass panel. Further, at least one cooling channel may be arranged between the second inner glass panel and the outer glass panel.

For example, the cooling channel may be connected or connectable to an active cooling system. Said active cooling system is usually a part of the cooking oven. The active cooling system may be arranged in the top of the cooking oven.

Alternatively, the cooling channel may be provided for a natural convection and/or a venturi effect.

The present invention relates further to a domestic cooking oven with at least one oven cavity, wherein the cooking oven comprises at least one oven door as described above.

Preferably, the cooking oven may comprise a cooling channel system connected or connectable to the oven door.

Novel and inventive features of the present invention are set forth in the appended claims.

Figure 2:
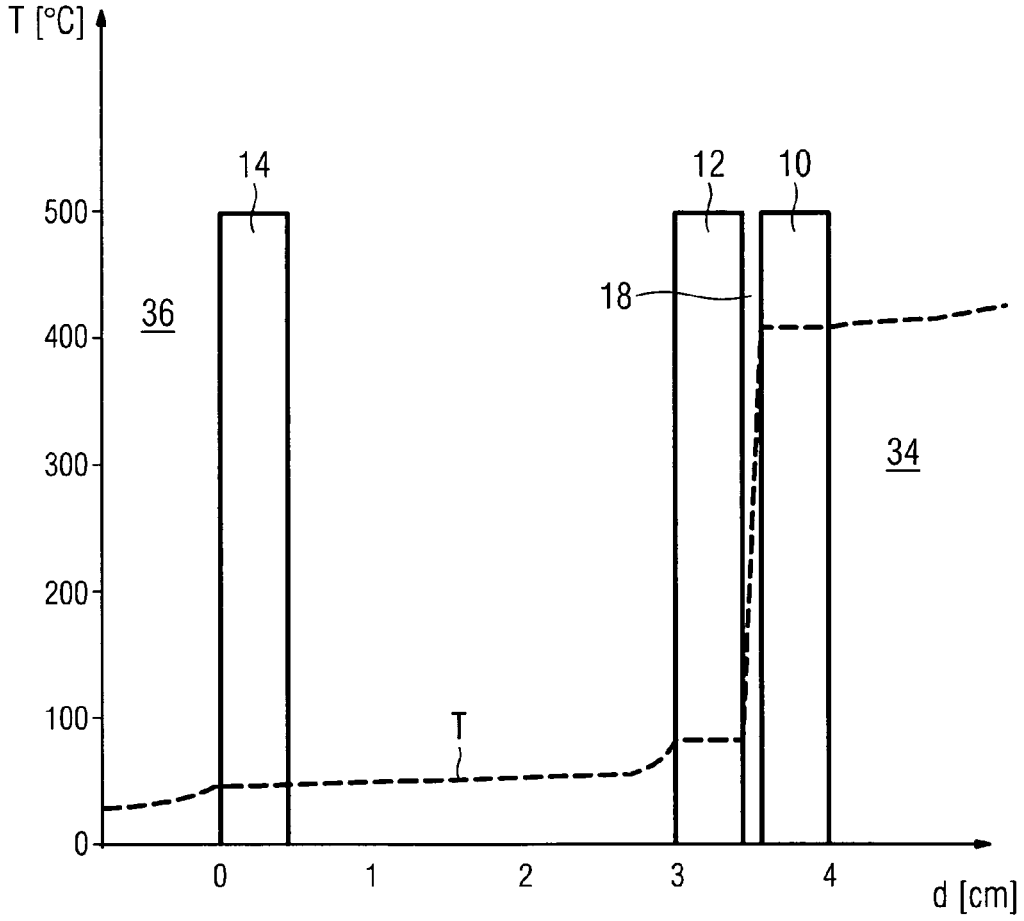

The present invention will be described in further detail with reference to the drawings, in which FIG. 1 illustrates a schematic sectional top view of a portion of an oven door for a domestic oven according to a preferred embodiment of the present invention, and FIG. 2 illustrates the schematic diagram of the temperature profile for the oven door according to the preferred embodiment of the present invention.

FIG. 1 illustrates a schematic sectional top view of a portion of an oven door for a domestic oven according to a preferred embodiment of the present invention. FIG. 1 shows the left portion of the oven door.

The oven door includes a first inner panel 10, a second inner glass panel 12 and an outer glass panel 14. The first inner glass panel 10 and the second inner glass panel 12 are arranged plane-parallel to each other. In this example, additionally the outer glass panel 14 is arranged plane-parallel to first inner glass panel 10 and the second inner glass panel 12.

At the lateral sides of the oven door a pair of door columns 16 is arranged between the outer glass panel 14 and the second inner glass panel 12 in each case. In this example, the first inner glass panel 10 and the second inner glass panel 12 have the same widths. In contrast, the outer glass panel 14 is wider than the first and second inner glass panels 10 and 12.

The distance between the first inner glass panel 10 and the second inner glass panel 12 is relative small. In this embodiment, the distance between the first inner glass panel 10 and the second inner glass panel 12 is between 0.5 mm and 1 mm. In contrast, the distance between the second inner glass panel 12 and the outer glass panel 14 is relative large. In this example, the distance between the second inner glass panel 12 and the outer glass panel 14 is about 3 cm.

An intermediate space 18 between the first inner glass panel 10 and the second inner glass panel 12 is void of air. The first inner glass panel 10 and the second inner glass panel 12 are combined by a solder 20. Said solder 20 fills the border area of the intermediate space 18. The heat conductivity of the intermediate space 18 is about $0.5 \cdot 10^{-3}$ W/(m·K).

An inner surface of the second inner glass panel 12 is coated by a reflective layer 22. Said reflective layer 22 includes high reflective material, so that the radiant heat from the oven cavity is reflected back. In particular, the reflected radiant heat has a wavelength substantially higher than 1700 nm.

Alternatively or additionally, an outer surface of the first inner glass panel 10 may be coated by a reflective layer, so that the emission of radiant heat from the oven cavity is reduced.

In FIG. 1 the oven door is in a closed state. Thus, the oven door is arranged besides a cavity wall 24, a front frame 26 and a casing 28 of the cooking oven. Between the cavity wall 24 and the front frame 26 on the one side and the first inner glass panel 10 on the other side a sealing element 30 is arranged. There is insulation 32 between the cavity wall 24 and the casing 28.

FIG. 2 illustrates a schematic diagram of the temperature profile for the oven door according to the preferred embodiment of the present invention.

In the oven cavity 34 and within the first inner glass panel 10 the temperature T is more than 400° C. At the inner side of the intermediate space 18 the temperature T is also more than 400° C., but at the outer side of the intermediate space 18 the temperature is about 80° C. There is a very high temperature difference of more than 300° C. within the intermediate space 18, which has a thickness of only 1 mm. It is a substantial property of the present invention that the temperature gradient is very high within the intermediate space 18.

In the second inner glass panel 12 the temperature T is also about 80° C. Between the second inner glass panel 12 and the outer glass panel 14 the temperature T is about 50° C. Within the outer glass panel 14 the temperature T is about 45° C., so that the temperature T in the ambiance 36 has a safe value.

In contrast, the temperature profile of a conventional oven door with equidistant glass panels has a substantially uniform temperature gradient.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 first inner glass panel
12 second inner glass panel
14 outer glass panel
16 door column
18 intermediate space
20 solder
22 reflective layer
24 cavity wall
26 front frame
28 casing
30 sealing element
32 insulation
34 oven cavity
36 ambiance
T temperature gradient
d thickness, distance

The invention claimed is:

1. An oven door for a domestic cooking oven, wherein the oven door comprises:

a first inner glass panel in direct contact with an oven cavity;

a second inner glass panel plane-parallel to the first inner glass panel;

a void of air intermediate space between the first inner glass panel and the second inner glass panel, wherein the first inner glass panel and the second inner glass panel form a module that comprises a border area around the void of air intermediate space, wherein the border area connects the first inner glass panel to the second inner glass panel;

a reflective layer at at least one of the inner side of the second inner glass panel in order to reflect radiant heat from the oven cavity and the outer side of the first inner glass panel in order to avoid emission of radiant heat from the oven cavity;

an outer glass panel in direct contact to an ambiance; and a door column arranged at an outer periphery of the oven door between the module and the outer glass panel, wherein the door column connects the module to the outer glass panel, and wherein the module extends to and contacts a first side of the door column and wherein the outer glass panel extends to and contacts a second side of the door column opposite the first side of the door column.

2. The oven door according to claim 1, wherein a thickness of the intermediate space is between 0.5 mm and 1 mm.

3. The oven door according to claim 1, wherein a heat conductivity of the intermediate space is lower than $10^{-2}$ W/(m·K).

4. The oven door according to claim 1, wherein circumferential sides of the intermediate space are enclosed by a solder, wherein the solder extends from an outer surface of the first inner glass panel to an inner surface of the second inner glass panel, and wherein the solder forms the border area of the module.

5. The oven door according to claim 1, wherein the reflective layer comprises high reflective properties in a wavelength range higher than 1700 nm.

6. The oven door according to claim 1, wherein at least one cooling channel is arranged between the second inner glass panel and the outer glass panel wherein the at least one cooling channel is connected or connectable to an active cooling system, and wherein the at least one cooling channel is provided for at least one of a natural convection and a venturi effect.

7. A domestic cooking oven with at least one oven cavity, wherein the cooking oven comprises at least one oven door according to claim 1.

8. The domestic cooking oven according to claim 7, wherein the cooking oven comprises a cooling channel system connected or connectable to the oven door.

9. The oven door according to claim 1, wherein a heat conductivity of the intermediate space is between $0.4 \cdot 10^{-3}$ W/(m·K) and $0.6 \cdot 10^{-3}$ W/(m·K).

10. The oven door according to claim 1, wherein the width of the first inner glass panel is the same as the width of the second inner glass panel.

11. The oven door according to claim 1, wherein a distance between the outer glass panel and the second inner glass panel is greater than a distance between the second inner glass panel and the first inner glass panel.

12. A domestic cooking oven comprising the oven door according to claim 1, wherein the oven further comprises a cavity wall defining an interior cavity of the oven and a casing defining an outer wall of the oven, wherein the first inner glass panel, the second inner glass panel, and the outer glass panel extend across a front of the interior cavity and extend beyond the cavity wall in a direction toward the casing.

13. The domestic cooking oven according to claim 12, wherein the border area is arranged proximate to the front of the interior cavity between the cavity wall and the casing.

14. The domestic cooking oven according to claim 12 further comprising a front frame connected to the casing and extending in a direction toward the outer glass panel.

15. The domestic cooking oven according to claim 14 further comprising a sealing element arranged between the oven door and the oven, wherein the sealing element contacts an inner surface of the first glass panel and at least one of the cavity wall and the front frame.

16. The domestic cooking oven according to claim 14, wherein the front frame extends toward the outer glass panel directly proximate to the oven door along an outer edge of the first glass panel and the second glass panel.

17. The domestic cooking oven according to claim 16, wherein the outer glass panel extends beyond the casing and wherein the front frame extends toward an inner surface of the outer glass panel and terminates directly proximate to the inner surface of the outer glass panel.

18. An oven door for a domestic cooking oven, wherein the oven door comprises:

a first inner glass panel in direct contact with an oven cavity;

a second inner glass panel plane-parallel to the first inner glass panel;

a void of air intermediate space between the first inner glass panel and the second inner glass panel, wherein the first inner glass panel and the second inner glass panel form a module that comprises a border area around the void of air intermediate space, wherein the border area connects the first inner glass panel to the second inner glass panel;

a reflective layer at at least one of the inner side of the second inner glass panel in order to reflect radiant heat from the oven cavity and the outer side of the first inner glass panel in order to avoid emission of radiant heat from the oven cavity; and an outer glass panel in direct contact to an ambiance, wherein a distance between the outer glass panel and the second inner glass panel is greater than a distance between the second inner glass panel and the first inner glass panel; and a door column arranged at an outer periphery of the oven door between the module and the outer glass panel, wherein the door column connects the module to the outer glass panel, and wherein the module extends to and contacts a first side of the door column and wherein the outer glass panel extends to and contacts a second side of the door column opposite the first side of the door column.

19. The oven door according to claim 1, wherein a distance between the outer glass panel and the second inner glass panel is thirty to sixty times greater than a distance between the second inner glass panel and the first inner glass panel.

20. The oven door according to claim 18, wherein the distance between the outer glass panel and the second inner glass panel is thirty to sixty times greater than the distance between the second inner glass panel and the first inner glass panel.

* * * * *